United States Patent [19]

Dietterich

[11] 3,937,537

[45] Feb. 10, 1976

[54] MOLDED PLASTIC REFRIGERATOR PAN AND WINDOW ASSEMBLY

[75] Inventor: Charles W. Dietterich, Columbus, Ohio

[73] Assignee: White-Westinghouse Corporation, Cleveland, Ohio

[22] Filed: Feb. 18, 1975

[21] Appl. No.: 550,699

[52] U.S. Cl. ..... 312/204; 49/34; 49/463; 52/208; 312/214; 312/351

[51] Int. Cl.[2] ..... A47B 88/00; E05C 21/02, E06B 1/60; 3/58

[58] Field of Search ..... 49/34, 141, 463, 465; 52/208, 308, 307; 312/116, 126, 140, 204, 257 A, 270, 293, 311, 351

[56] References Cited

UNITED STATES PATENTS

| | | | |
|---|---|---|---|
| 2,689,778 | 9/1954 | Chambers et al. | 312/351 |
| 2,773,289 | 12/1956 | Martin et al. | 52/208 |
| 3,129,987 | 4/1964 | Hill | 312/204 |
| 3,792,551 | 2/1974 | Hallas | 49/463 |

FOREIGN PATENTS OR APPLICATIONS

| | | | |
|---|---|---|---|
| 237,656 | 12/1964 | Austria | 52/208 |
| 22,162 | 10/1961 | Germany | 49/34 |

*Primary Examiner*—Paul R. Gilliam
*Assistant Examiner*—Carl F. Pietruszka
*Attorney, Agent, or Firm*—Strauch, Nolan, Neale, Nies & Kurz

[57] ABSTRACT

A plastic molded refrigerator pan and window assembly in which the front wall of the pan includes a large opening within which is disposed a separable snap-engaging clear plastic panel. The engagement is provided by upper and lower channels provided in the respective edges of the panel which engage opposing sides of the front wall adjacent the edge of the opening. Because of the generally unsupported and flexible nature of the front wall along the upper edge of the opening, the panel engaging structure includes tab portions of varying height which in certain areas snap into the respective opposing channel and at other areas require sufficient forceful displacement of the top of the wall to seat the tab in the flange so that unintended disengagement is prevented even at the most flexible area of the panel.

5 Claims, 4 Drawing Figures

MOLDED PLASTIC REFRIGERATOR PAN AND WINDOW ASSEMBLY

BACKGROUND OF THE INVENTION

1. Field of the Invention

This invention relates to refrigerator pans of the type generally used to store food in a refrigerator and more particularly to a plastic molded refrigerator pan having a clear panel in the front wall for viewing into the pan.

2. Description of the Prior Art

Refrigerator pans of the general nature of the present invention including plastic molded pans are well known in the art. However, it is generally required to pull the pans forward of their storage position to view their contents unless they are constructed of a clear material such as plastic or, have a separate window in the front face.

The main disadvantage of a pan that is completely transparent resides in the fact that it is easily scratched, especially over those surfaces that have sliding contact with other parts of the refrigerator, and thereby becomes generally unattractive.

The alternative structure of a transparent panel in the forward wall permits either an integrally molded panel or a separately molded panel that can be welded or glued to the front wall either of which is generally expensive in its fabrication and also requires a completely new pan to replace it should it become scratched or damaged. Or, a removable clear panel can be used to permit viewing, the molding and assembly of which is relatively inexpensive and also permits the panel to be easily replaced if damaged without requiring the whole pan to be replaced.

SUMMARY OF THE PRESENT INVENTION

The present invention provides a plastic molded refrigerator pan with a separately molded clear plastic panel received over an opening in the front wall of the pan. The panel is relatively easily inserted and locked into place by cooperating interengaging edges of the opening received in channels in opposing edges of the panel. To this end, tabs are provided along the upper horizontal edge of the opening generally adjacent an integrally molded handle of the pan. The tab generally adjacent the center of the opening is greater in height than tabs adjacent the sides, with the height generally related to the amount of flexure of the flexible upper portion of the front wall in that this portion is not supported therebehind by other pan structure as are the sides and bottom of the front wall. The tabs are tapered to permit camming the upper channel of the panel into proper engagement by upward and rearward displacement of the shorter tabs, whereas the portion of the edge having the tab with greatest height must in addition be somewhat manually twisted to permit engagement of the tab into the channel, which movement generally insures that unintended disengagement is prevented.

DESCRIPTION OF THE PREFERRED EMBODIMENT

Figure 1:
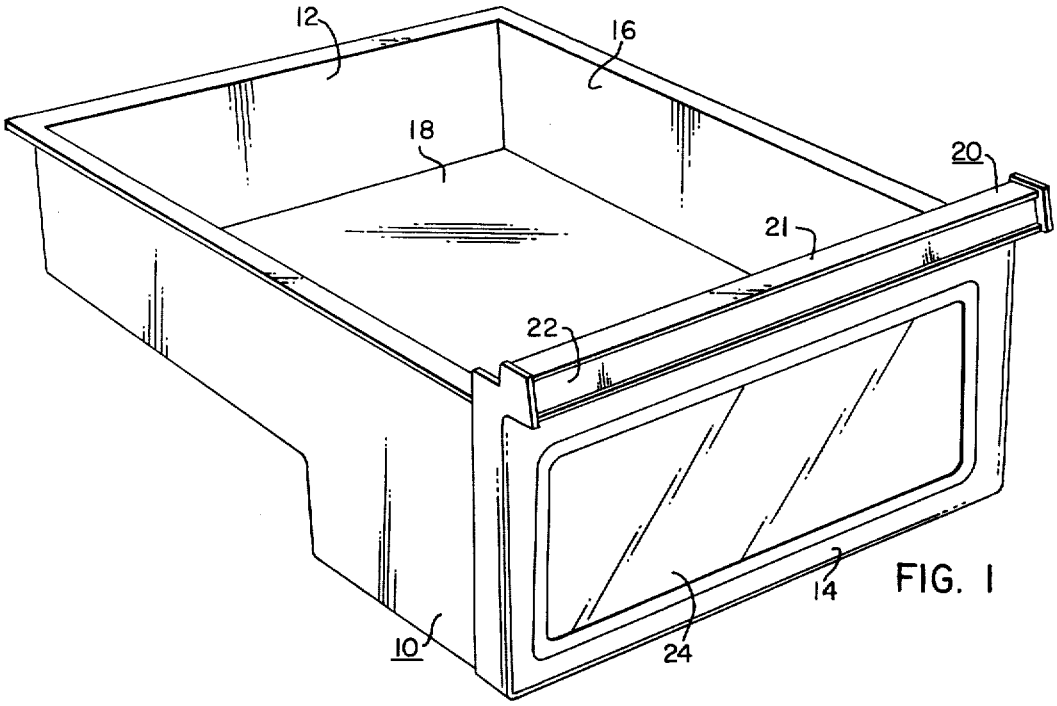
FIG. 1 is an isometric view of the refrigerator pan and panel assembly of the present invention.

Referring to FIG. 1, the refrigerator pan 10 of the present invention is preferably molded of a suitable plastic and comprises generally a planar wall structure such as a back wall 12, front wall 14, and opposed side walls 16. The bottom 18 of the pan is contoured so as to fit on the bottom wall of a refrigerator which itself has a similar contour to accommodate a machine compartment as is well known in the art. The front wall 14 includes an integrally molded forwardly projecting handle 20 comprising a generally inverted "L" configuration with the foot 21 thereof providing a forwardly extending flange and the leg 22 providing a downwardly extending gripping lip.

As seen in FIG. 1 the front wall 14 has a generally clear panel 24 mounted to cover a substantial portion thereof and permitting viewing into the pan. The present invention is primarily directed to the structure for releasably retaining the separately molded clear plastic panel 24 within the appropriately sized opening 25 of the front wall.

Figure 2:
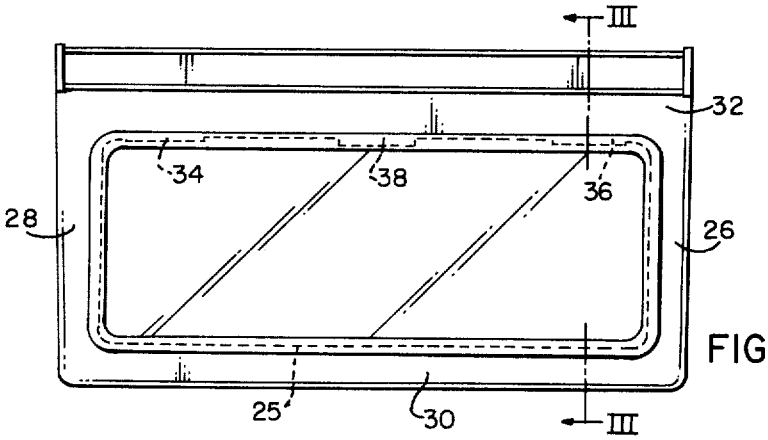
FIG. 2 is an elevational front view of the pan showing the opening in the front panel.

Referring now to FIG. 2, it is seen that the front wall 14 defines an opening 25 over a substantial portion thereof resulting in a generally narrow peripheral frame comprising opposing side framing flanges 26, 28 a lower horizontal framing flange 30 and an opposed upper horizontal framing flange 32. It is to be noted that all framing flanges except for the upper horizontal flange 32 are adjacent, and integral with, rearwardly extending wall structure of the pan; however, in that the pan has an open top, there is no rearwardly extending wall ingetral with this upper flange 32. Thus with the upper flange being unsupported therebehind, and also integral with the handle, it is evident that flange 32 provides the least resistance to the deflections resulting from external forces, such as pulling or lifting by the handle, which deflection will normally result in the greatest displacement of the front wall at or near the center of the upper flange.

Still referring to FIG. 2, it is seen that, in the preferred embodiment, three tab members 34, 36, 38 extend downwardly into the opening from the edge of the upper framing flange 32. Two tabs 34, 36 are disposed generally adjacent the side flanges whereas the remaining tab 38 is generally centrally located. Tab 38, for reasons to be subsequently explained has a greater height then either of the other tabs which, in this instance, are generally equal in height. Except for the tabs, the remaining edges of the framing flanges bounding the opening are generally flat across the thickness thereof.

Figure 3:
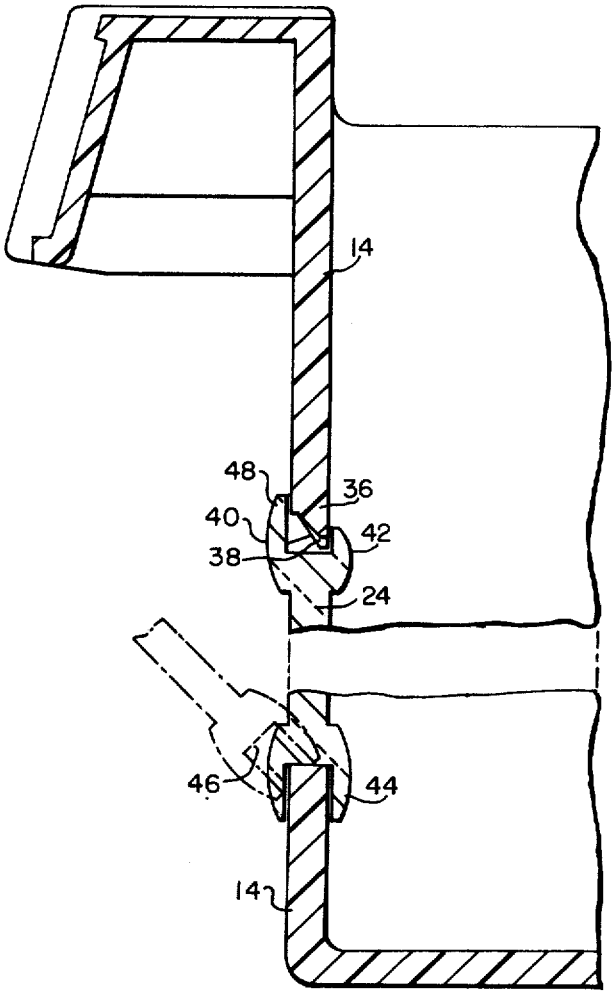
FIG. 3 is a cross-sectional elevational view taken along lines III—III of FIG. 1.

Referring now to FIG. 3 in conjunction with FIG. 1 to describe the clear panel 24, it is seen that for the most part the panel is planar and bounded along its edges by a generally arcuate bead 40 on its forward face, that in the assembled position, overlies the marginal edges defining the opening 25. Similar beads 42 and 44 extend along the upper and lower edges of the rear face of the panel 24 respectively. (Although not shown, such rearwardly facing beads do not exist along the vertical edges of the panel.) Along the lower edge of panel 24 the opposing (i.e. front and rear) beads 40, 44 define therebetween a channel 46 extending across the length of the panel and having a width slightly greater than the thickness of the wall 14.

The rearwardly facing bead 42 along the top edge of the panel is seen to be shorter in cross section than the opposing rearwardly facing bead 44 and also defines an arcuate surface. However, as before, the opposed beads 40, 42 define therebetween a channel 48 having a width slightly greater than the thickness of the front wall. Also, it is to be noted that the height of the rear bead 42 along the top edge, when the panel is properly disposed with the lower flange 30 of the wall received within the lower channel 46 of the panel, is such that it passed through the opening 25 without interference with the edge of the upper flange 32. However, in those areas where the tabs 34, 36, 38 extend into the opening, there is interference engagement between the tabs and the rear bead 42. To this end, the forwardly facing surface of each tab 34, 36, 38 is tapered to provide a rearwardly downwardly extending surface (as at 50) that, as the panel 24 is moved into position, contacts the rounded surface of the rear bead 42. These surfaces cooperate to cam the upper flange 32 sufficiently upwardly and outwardly to permit passage of the panel to a substantially vertical position wherein the shorter tabs 34, 36 snap into the channel 48 of the panel.

Figure 4:
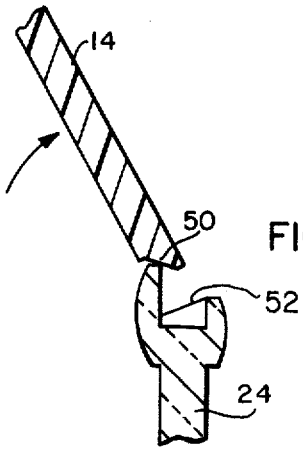
FIG. 4 is a view similar to FIG. 3 with the upper portion of the front wall of the pan flexed for receipt of the panel during assembly.

However, because of the height of the middle tab 38 and also because of the increased flexure of the flange 32 in this central area, there is not sufficient opposing forces between the engaging cam surfaces 50 and 42 to elevate the flange sufficiently to permit the center tab to be so engaged. Thus, the forward flange 32 must be manually flexed i.e. twisted as shown in FIG. 4, to attain sufficient alignment of the central tab 38 with the channel 48 for a snap engagement. It is noted from FIG. 4, the twisting is in a direction opposite to the type of twisting induced in the front flange when the pan is carried by the handle 20. Thus, the disengaging action requiring the same type of twisting as the engagement, is, under normal conditions, not associated with the normal use of the pan.

Referring again to FIG. 3, the two separate heights of the tabs (38 vs. 34, 36) are shown, only to illustrate the receipt of the tabs within their respective channels. It is therein clearly illustrated that tab 38 being at the center of the flange 32 where the flange permits the maximum deflection, has a greater height than the tabs 34, 36 adjacent the sides. As previously stated, the height of each tab is generally related to the corresponding relative deformation or deflection of the adjacent flange area to accommodate the deflection in this area whenever the pan might be supported by the handle under heavily loaded conditions without separating the engaging tabs and the channels out of the locking engagement. Thus, the greatest deflection being permitted at generally the center of the top flange, the tab in this area has a height greater than any of the other tabs and greater than the normal deflection of this area under most circumstances.

It is apparent that although three separate tabs are shown, a single tab of ever increasing height towards the center could also be utilized to accomplish the same result. In such instance the upper channel 48 would be continuous across the length of the panel. However, in the preferred embodiment the tabs are received in corresponding separate or partitioned portions of the channel, with the back bead 42 occasionally joined to the front bead 40 by supporting or strengthening partitioning walls 52 extending therebetween and properly spaced along its length.

I claim as my invention:

1. A plastic molded refrigerator pan and window assembly wherein said pan includes a generally planar front wall having an opening across a substantial area thereof and thereby bounded by opposed upper and lower horizontally extending framing flanges integral with opposed vertical side framing flanges, and a generally transparent molded plastic panel generally coextensive with said opening and including a forwardly facing peripheral bead generally overlapping the edge of said opening and first and second inwardly facing bead means;

said first inwardly facing bead means extending along at least a portion of the bottom of said panel in juxtaposition with opposite portions of said forwardly facing bead to define therebetween a channel at the lower edge of said panel for receipt therein of the edge of the lower framing flange;

said second inwardly facing bead means extending along at least a portion of the top of said panel in juxtaposition with opposite portions of said forwardly facing bead to define therebetween a channel at the upper edge of said panel; and tab means extending downwardly from the edge of said upper framing flange, at least in areas generally adjacent each side and generally midway therebetween, said tab means having a downwardly inwardly tapered surface and wherein said middle tab has a height greater than the other of said tab means to the extent that as said panel is inserted by effecting the lower channel and edge engagement and moving said panel to a vertical position by passing said second inwardly facing bead means through said opening, said bead means and said other of said tab means cooperate to cam said other of said tab means upwardly to permit engagement of said tabs in said upper channel whereas the greater height of said tab adjacent the midway position requires said upper flange to be somewhat manually twisted for sufficient alignment between the upper channel and said tab means for said tab means to be seated within said channel thereby with the release of said twisting force, locking said panel in position.

2. Structure according to claim 1 wherein said front wall includes an integrally molded handle extending thereacross generally adjacent said upper framing flange and wherein said twisting force is in a direction opposite twisting forces introduced into said upper framing flange when said pan is manually lifted or pulled by said handle.

3. Structure according to claim 2 wherein said second inwardly extending bead has an arcuate profile for contacting said tab means to facilitate said camming action.

4. Structure according to claim 3 wherein said second inwardly extending bead is free to pass the edge of the upper framing flange except for said tab means extending therefrom.

5. Structure according to claim 4 wherein said tab means includes at least three distinct tab members extending from said edge of said upper framing flange for receipt in the upper channel of said panel.

* * * * *